United States Patent [19]

Wirsbinski et al.

[11] Patent Number: 4,470,441

[45] Date of Patent: Sep. 11, 1984

[54] HYDRAULIC WOOD SPLITTER

[75] Inventors: James L. Wirsbinski, Marshfield; Dale A. Manteufel, Hortonville, both of Wis.

[73] Assignee: Ingersoll Equipment Co., Inc., Winneconne, Wis.

[21] Appl. No.: 527,175

[22] Filed: Aug. 26, 1983

[51] Int. Cl.[3] ..... B27L 7/00

[52] U.S. Cl. ..... 144/193 A; 144/193 D; 144/193 E

[58] Field of Search ..... 144/3 K, 193 R, 193 A, 144/193 D, 193 E, 193 F, 193 J

[56] References Cited

U.S. PATENT DOCUMENTS

| | | | |
|---|---|---|---|
| D. 261,143 | 10/1981 | Green | D15/127 |
| 4,112,985 | 9/1978 | Gosselin | 144/193 A |
| 4,141,396 | 2/1978 | McCallister | 144/193 A |
| 4,199,015 | 4/1980 | Doering | 144/193 A |
| 4,293,070 | 12/1980 | Burns | 144/193 A |
| 4,295,506 | 10/1981 | Nicholson | 144/193 D |
| 4,366,848 | 1/1983 | Gavinski | 144/193 A |
| 4,411,298 | 10/1983 | Ellingsen et al. | 144/193 A |

FOREIGN PATENT DOCUMENTS

| | | | |
|---|---|---|---|
| 23649 | 6/1958 | Australia | 144/193 A |
| 982032 | 1/1976 | Canada | 144/193 D |

*Primary Examiner*—W. D. Bray
*Assistant Examiner*—Jorji M. Griffin
*Attorney, Agent, or Firm*—Dressler, Goldsmith, Shore, Sutker & Milnamow, Ltd.

[57] ABSTRACT

A hydraulic wood splitter is disclosed which is configured for highly efficient and convenient wood splitting operation. In order to retain wood being split in proper position on the frame of the splitter, the construction includes a wood-retaining configuration for the wood-abutting splitting rams of the construction. Each ram includes a peripherally extending retaining lip which cooperates with an elongated slot defined by the frame of the splitter for retention of wood in proper position thereon. Additionally, the splitting wedge of the device is provided with a dual-tapered or double-beveled configuration for further facilitating convenient and efficient wood splitting.

11 Claims, 4 Drawing Figures

HYDRAULIC WOOD SPLITTER

TECHNICAL FIELD OF THE INVENTION

The present invention pertains generally to hydraulically operated wood or log splitters attachable to a tractor or the like, and more particularly, to an improved hydraulic wood splitter having an improved wood-retaining and splitting construction.

BACKGROUND OF THE INVENTION

Hydraulically operated wood splitting devices are well-known and therefore have been provided in a variety of forms. One particularly efficient, highly versatile, and conveniently operated wood splitting device is of the self-elevating type such as disclosed in commonly assigned co-pending applications Ser. No. 485,964, filed Apr. 18, 1983, and Ser. No. 486,933, filed Apr. 20, 1983. These self-elevating wood splitters are desirably compact such that they may be used as attachments to tractors or other implements having a source of hydraulc power. In addition to being compact, these self-elevating wood splitters are capable of generating relatively high splitting forces, and therefore can be used efficiently for splitting relatively large logs or pieces of wood. Each of these self-elevating wood splitters includes a hydraulic actuator comprising a cooperating cylinder and ram which in combination generate the high splitting force necessary to cut large logs and pieces of wood.

After initial placement of a log or piece of wood on the frame of a splitter, it is desirable that the log or piece of wood be retained on the wood supporting frame of the splitter during operation. However, it can be inconvenient for the user to manipulate the wood to keep the wood properly positioned on the splitter frame, particularly if the end portions of the piece of wood are disposed at an angle to the line of splitting force, since the forces generated can tend to dislodge or "cock" the wood from its desired position. Therefore, it is desirable to have the wood retained in proper position on the frame as conveniently and efficiently as possible to further facilitate efficient and convenient use of the wood splitting machine.

To this end, the present wood splitter includes a wood-retaining frame construction including retaining means that are adapted to initially engage the log or wood to provide retention of the log on the wood splitter frame immediately upon beginning of the splitting operation. Additionally, the present splitter includes a splitting wedge having double-beveled or dual-tapered configuration which acts in combination with the retaining means of the splitter to further facilitate efficient operation.

SUMMARY OF THE INVENTION

The wood splitter of the present invention is desirably configured to automatically retain logs or other pieces of wood in proper position on the wood supporting frame of the splitter during splitting operations, even if the pieces of wood have end portions which are not disposed perpendicularly to the line of splitting force of the splitter. Additionally, the present hydraulic wood splitter includes a splitting wedge having a dual-tapered or double-beveled cutting portion to facilitate highly efficient cutting action. The inclusion of the dual-tapered cutting portion allows the high splitting forces generated by the wood splitter's hydraulic actuator to be translated into a high initial penetrating force for cutting knots or stringy material, and desirably provides the cutting edge with sufficient stiffness to resist rippling or any tendency of the cutting edge to follow the wood grain. The inwardly disposed portion of the dual-tapered wood cutting portion is defined by an included angle which is substantially less than the included angle defining the outermost splitting surfaces, thus allowing the splitting wedge to pass through wood relatively easily with less required splitting force.

The wood splitter of the present invention is desirably adapted to be mounted on a tractor or like implement, and includes an elongated wood supporting frame which extends rearwardly of the tractor, and which includes a horizontal upper surface. The upper surface of the frame preferably defines an elongated slot which acts to maintain wood received upon the upper surface of the frame in proper position with respect thereto.

The present splitter further includes splitting wedge means and splitting ram means associated with the wood supporting frame. The hydraulic motor, preferably comprising a double-acting hydraulic actuator, is mounted on the frame, and is operatively connected with one of the splitting ram means and splitting wedge means for relatively moving the ram means and wedge means toward each other for splitting of wood therebetween. In the illustrated embodiment, the splitting wedge means comprises a splitting wedge having a pair of oppositely disposed cutting edges, while the ram means comprises a pair of rams generally disposed at respective opposite ends of the frame for respective coaction with the cutting edges of the splitting wedge. It will be recognized, however, that while the present wood splitter has been illustrated as a so-called "double-acting" type, a wood splitter embodying the principles of the present invention may be configured as a "single-acting" type of splitter.

Significantly, the ram means of the present splitter is configured to coact with the elongated slot defined by the splitter's wood supporting frame for retaining a piece of wood in proper position on the frame. The ram means comprises a generally vertically oriented ram having a ram face extending transversely of the wood supporting frame and perpendicular to the upper surface of the frame. The ram means further include retaining lip means extending about the peripheral portion of and projecting from the ram face. The peripherally extending, generally U-shaped configuration of the retaining lip means desirably acts to retain a piece of wood on the upper surface of the splitter's frame during splitter operation. The configuration of the lip means is such that the end portion of a piece of wood being split is penetrated by or confined within the peripherally extending lip means so that the wood is held in proper position on the splitter frame. Thus, efficient and convenient operation of the splitter is greatly facilitated.

To further enhance the efficiency of the present splitter, it preferably includes a splitting wedge having a dual-tapered or double-beveled configuration. Specifically, the splitting wedge includes a pair of oppositely disposed, dual-tapered cutting portions respectively defining a pair of oppositely disposed cutting edges. Each dual-tapered portion of the splitting wedge defines a first outermost splitting portion having a pair of divergent first splitting surfaces, and a second splitting portion disposed inwardly of and adjacent to the first splitting portion, and having a pair of divergent second splitting surfaces.

Notably, the first divergent splitting surfaces, which meet to form the cutting edge of the wedge, are defined by a first included acute angle which is substantially greater than a second included acute angle which defines the second splitting surfaces of the second splitting portion. In the preferred form, the first included angle is approximately twice the second included angle. By this configuration, the sharpness of the cutting edge is desirably maintained, and avoids the need for heat-treating of the cutting edge which would otherwise make the edge excessively brittle. The relatively lesser second included angle allows the splitting wedge to pass through wood more easily after initial penetration by the first splitting surfaces of the outermost first splitting portion. Again, highly efficient wood splitting is facilitated by this unique arrangement.

Numerous other features and advantages of the present invention will become readily apparent from the following detailed description, appended claims, and accompanying drawings.

DETAILED DESCRIPTION

Figure 1:
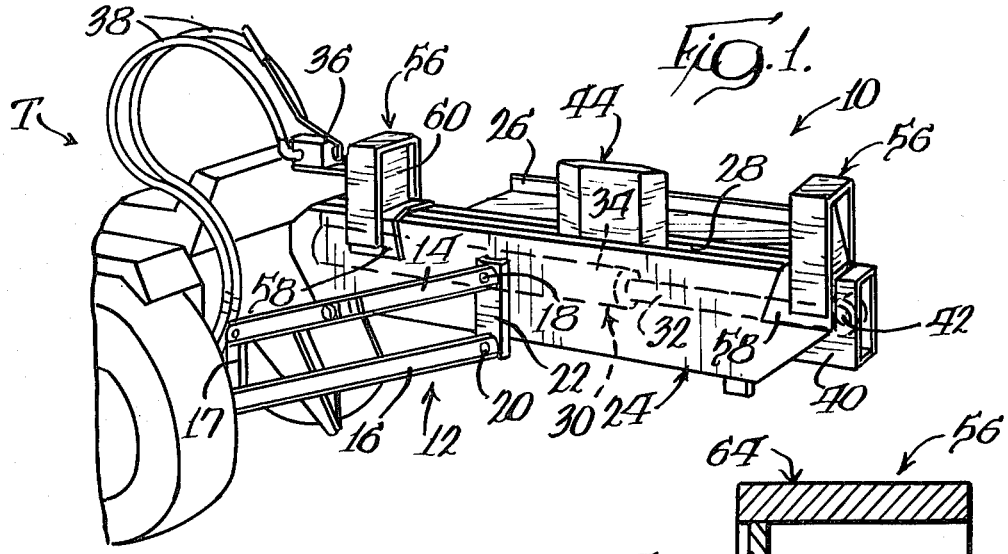
FIG. 1 is a perspective view of a wood splitting machine embodying the principles of the present invention mounted for use on a tractor.

While the present invention is susceptible of embodiment of in various forms, there is shown in the drawings and will hereinafter be described a presently preferred embodiment with the understanding that the present disclosure is to be considered as an exemplification of the invention and is not intended to limit the invention to the specific embodiment illustrated.

With reference now to FIG. 1, therein is illustrated a wood splitter 10, embodying the principles of the present invention, mounted on the rear of a tractor, generally designated T. Wood splitter 10 is illustrated as including a self-elevating supporting arrangement generally of the type disclosed in co-pending applications Ser. No. 485,964, filed Apr. 19, 1983, and Ser. No. 486,933, files Apr. 20, 1983. This self-elevating mechanism includes a pair of four-bar linkages 12 (one being shown) each including a top link 14 and bottom link 16 pivotally connected at respective ends thereof to a mounting plate 17 attached to tractor T. The opposite respective ends of links 14 and 16 are respectively pivotally connected at 18 and 20 to a mounting plate 22. It will be understood that in the typical construction, a pair of four-bar linkages 12 are provided on respective opposite sides of the splitter 10.

As further illustrated in FIG. 1, splitter 10 includes a generally elongated splitter frame 24 connected to mounting plate 22 having an upper horizontal surface which defines an elongated slot 28. Additionally, splitter 10 can include a cutting table 26 for added convenience during splitting operations.

The working action of splitter 10 is provided by a double-acting fluid ram or hydraulic actuator 30, as shown in phantom line in FIG. 1. Hydraulic actuator 30 is of conventional construction, and includes a piston 32 moveably disposed within a cylinder 34. A hydraulic valve 36 is typically provided for operation of actuator 30, with fluid communication of the actuator with a suitable source of pressurized hydraulic fluid on tractor T being provided via hydraulic lines 38.

To effect wood splitting, the present splitter includes splitting wedge means and splitting ram means, with actuator 30 operatively connected with one of the wedge means and ram means. Accordingly, cylinder 34 of actuator 30 is fixedly connected with splitter frame 24, while piston 32 of the actuator 30 is operatively connected with a generally box-shaped beam 40 at connection 42. Beam 40 is mounted within frame 24 for longitudinal, reciprocating movement with respect thereto in response to fluid pressurization of actuator 30.

Figure 4:
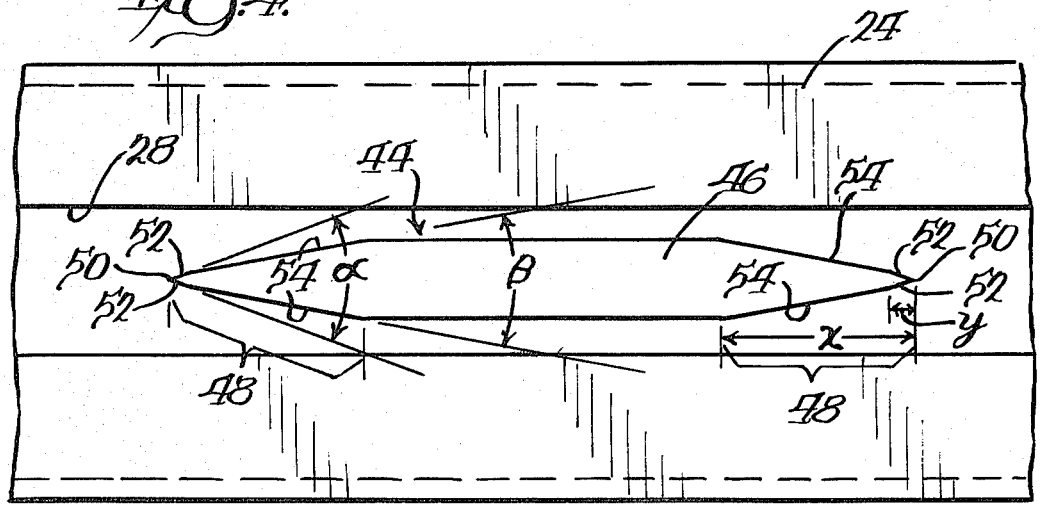
FIG. 4 is an enlarged top plan view illustrating the wood splitting wedge of the present splitter.

Splitting wedge 44 is fixedly connected to beam 40, and extends upwardly therefrom through elongated slot 28 for reciprocating movement logitudinally of splitter 10. Notably, wedge 44 is provided with a dual-tapered configuration at each of its oppositely disposed cutting portions. This construction is best illustrated in FIG. 4 which shows wedge 44 as including a central body portion 46, and a pair of oppositely disposed dual-tapered or double-beveled portions 48 respectively defining a pair of oppositely disposed knife-like cutting edges 50.

The configuration of dual-tapered portions 48 has been found to particularly enhance the splitting efficiency of splitter 10. Each dual-tapered portion 48 includes a first outermost splitting portion having a pair of divergent first splitting surfaces 52 which define cutting edge 50. Each dual-tapered portion 48 further includes a second splitting portion disposed adjacent the first splitting portion including a pair of second divergent splitting surfaces 54. As shown in FIG. 4, first divergent splitting surfaces 52 are defined by a first included acute angle "alpha" which is sustantially greater than a second included acute angle "beta" which defines second divergent splitting surfaces 54. Significantly, this dual-tapered configuration has been found to provide a high initial penetrating splitting force at cutting edge 50 defined by splitting surfaces 52, with the more gradual taper of second splitting surfaces 54 allowing the wedge 44 to pass through wood more easily with less required force.

In the preferred form, first included angle "alpha" is approximately twice the value of second included angle "beta." Angle "alpha" is preferably selected in the range of approximately 16 to 24 degrees, with an angle 20 degrees having proved particularly suitable. Angle "beta" is thus preferably provided in the range of about 8 to 12 degrees. As also shown in FIG. 4, the length "y" of the first splitting portion including surfaces 52 comprises approximately 10 to 20 percent of the total length "x" of the dual-tapered portion 48.

For wood splitting coaction with splitting wedge 48, splitter 10 includes a pair of wood-abutting rams 56 disposed at respective opposite ends of splitter frame 24. Significantly, each of splitting rams 56 is configured to act to retain a piece of wood on the upper surface of frame 24 during splitter operation, thus greatly facilitating convenient and efficient use of the splitter.

Figure 2:
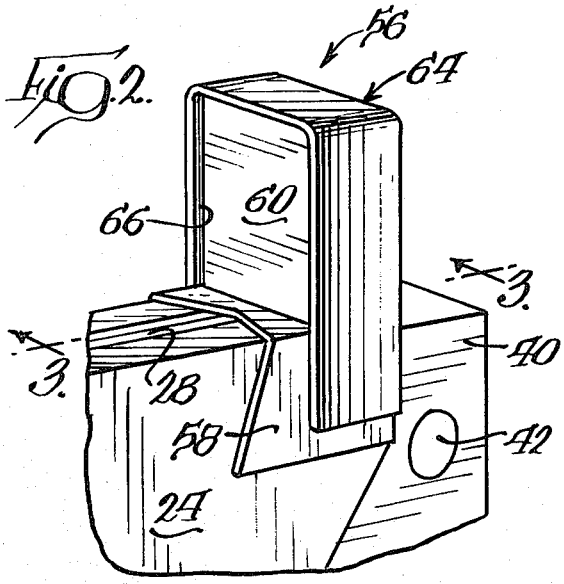
FIG. 2 is a fragmentary, enlarged perspective view of the wood-retaining ram of the present wood splitter.
Figure 3:
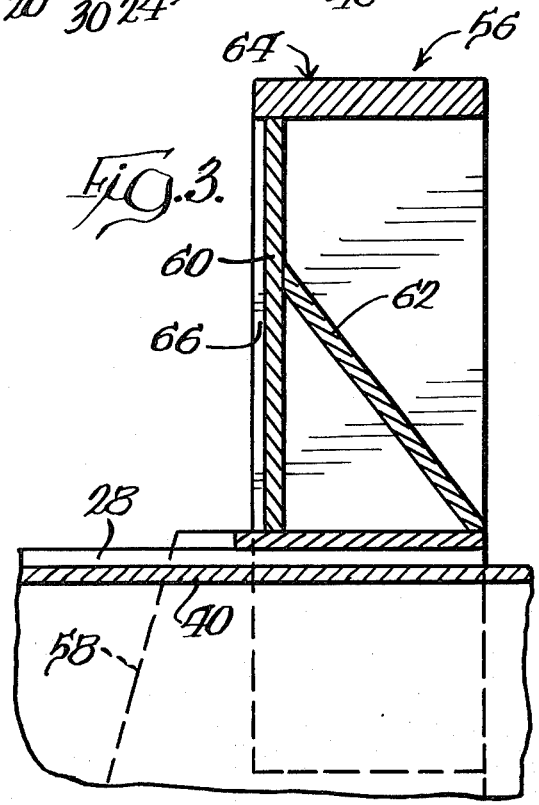
FIG. 3 is a cross-sectional view taken along plane 3—3 of FIG. 2.

As best illustrated in FIGS. 2 and 3, each splitting wedge 56 comprises a mounting member 58 fixed to splitter frame 24, and an upstanding ram face 60 extending transversely of frame 24 and perpendicularly to its upper surface. A reinforcement member 62 extends between the ram face 60 and the mounting member 58 of each ram 56 to assure that the ram face 60 is firmly maintained in this generally vertical orientation.

Notably, such ram 56 further includes a generally U-shaped retaining member 64 extending about the entire periphery of ram face 60. Ram face 60 is recessed with respect to retaining member 64 to thus provide peripherally extending retaining lip 66 which projects perpendicularly from the surface of ram face 60. This unique configuration for each splitting ram 56 acts to retain a piece of wood in proper position on the upper surface of splitter frame 24 since retaining lip 66 will usually initially engage and penetrate of wood being split, thus resisting any tendency of the piece of wood to slip or become dislodged attendant to operation of hydraulic actuator 30. This retaining configuration of each ram 56 is particularly advantageous for splitting logs or pieces of wood having end surfaces which are not parallel to ram faces 60. For example, a log having a somewhat angled end surface, which of course may be the case in many instances, might otherwise tend to become dislodged from its proper position on frame 24 without the retaining action of lip 66. It will be appreciated that the peripherally extending nature of each lip 66 resists both sideways and upward movement of a piece of wood as it is subjected to splitting by coaction of wedge 44 and one of rams 56.

From the foregoing, it will be observed that numerous modifications and variations can be effected without departing from the true spirit and scope of the novel concept of the present invention. It will be understood that no limitation with respect to the specific apparatus illustrated herein is intended or should be inferred. It is, of course, intended to cover by the appended claims all such modifications as fall within the scope of the claims.

What is claimed is:

1. A wood splitter adapted to be mounted on a tractor or the like, comprising:

an elongated wood supporting frame extending rearwardly of said tractor and having an upper surface;

splitting wedge means associated with said frame;

splitting ram means associated with said frame; and hydraulic motor means on said frame operatively connected with one of said splitting ram means and said splitting wedge means for relatively moving said ram means and said wedge means toward each other for splitting wood;

said ram means comprising a ram having a ram face extending transversely of said frame and perpendicular to said upper surface of said frame;

said ram means further including retaining lip means extending about the peripheral portion of said ram face, said retaining lip means acting to retain wood on said upper surface of said frame during splitter operation.

2. The wood splitter in accordance with claim 1, wherein said hydraulic motor means comprises a hydraulic actuator operatively connected with said splitting wedge means for moving said wedge means with respect to said splitting ram means for splitting wood.

3. The wood splitter in accordance with claim 2, wherein said splitting wedge means comprises a splitting wedge having a pair of oppositely disposed cutting edges, said splitting ram means comprising a pair of rams disposed generally at respective opposite ends of said frame each having a ram face extending transversely of said frame and perpendicular to the upper surface of said frame, said ram means further including retaining lip means extending about the peripheral portion of each of said ram faces, said cutting edges being adapted to respectively coact with said pair of rams for splitting said wood.

4. The wood splitter in accordance with claim 1, wherein said splitting wedge means includes a dual-tapered cutting portion defining a first outermost splitting portion having a pair of divergent first splitting surfaces, and a second splitting portion disposed inwardly of and adjacent to said first splitting portion and having a pair of divergnt second splitting surfaces, said first divergent splitting surfaces being defined by a first included acute angle which is substantially greater than a second included acute angle defining said second splitting surfaces.

5. The wood splitter in accordance with claim 4, wherein said outermost first splitting portion comprises approximately 10 to 20 percent of the total length of said dual-tapered portion, said second splitting portion comprising the remainder of said dual-tapered portion.

6. A wood splitter adapted to be mounted on a tractor or the like, comprising:

an elongated wood supporting frame extending rearwardly of said tractor and having a horizontal upper surface defining an elongated slot;

a splitting wedge associated with said frame and projecting upwardly from said elongated slot, said splitting wedge including a pair of oppositely disposed cutting edges;

a pair of splitting rams generally disposed at respective opposite ends of said frame adapted to respectively cooperate with said cutting edges of said wedge for splitting wood, each of said rams including a ram face extending transversely of said frame and perpendicular to said upper surface of said frame; and retaining lip means extending peripherally about and projecting from each said ram face for cooperation with said elongated slot for retaining wood on said frame during splitting operation.

7. The wood splitter in accordance with said claim 6, wherein said splitting wedge includes a pair of oppositely disposed dual-tapered cutting portions respectively defining said cutting edges, each said dual-tapered portion defining a first outermost splitting portion having a pair of divergent first splitting surfaces, and a second splitting portion disposed inwardly of and adjacent to the first splitting portion and having a pair of divergent second splitting surfaces, said first divergent splitting surfaces being defined by a first included acute angle which is substantially greater than a second included acute angle defining said second splitting surfaces.

8. The wood splitter in accordance with claim 7, wherein said first acute angle comprises an angle in the range of about 16 to 24 degrees, and said second acute angle comprises an angle in the range of about 8 to 12 degrees such that said first angle is approximately twice said second angle.

9. A wood splitter adapted to be mounted on a tractor or the like, comprising:

an elongated wood supporting frame extending rearwardly of said tractor and having an upper surface for receiving wood to be split;

splitting wedge means associated with said frame;

splitting ram means associated with said frame.

said ram means comprises a ram face extending transversely of said frame and perpendicular to said upper surface, and retaining lip means extending peripherally about and projecting from said ram face;

hydraulic motor means on said frame operatively connected with one of said ram means and said wedge means for relatively moving ram means and said wedge means for splitting wood therebetween;

said splitting wedge means having a dual-tapered cutting portion defining a cutting edge, and further defining a first outermost splitting portion having a pair of divergent first splitting surfaces defined by a first acute angle, and a second splitting portion disposed adjacent and inwardly of said first splitting portion and having a pair of divergent second cutting surfaces defined by a second acute angle, said first acute angle being approximately twice the value of said second acute angle.

10. A wood splitter in accordance with claim 9, wherein said first acute angle comprises an angle in the range of about 16 to 24 degrees, and said second acute angle comprises an angle in the range of about 8 to 12 degrees.

11. A wood splitter in accordance with claim 9, wherein said outermost first splitting portion comprises approximately 10 to 20 percent of the total length of said dual-tapered portion, said second splitting portion comprising the remainder of said dual-tapered portion.

* * * * *